United States Patent [19]

Cross

[11] 4,344,554

[45] Aug. 17, 1982

[54] STAPLING APPARATUS

[75] Inventor: Thomas R. Cross, Williamson, N.Y.

[73] Assignee: Xerox Corporation, Stamford, Conn.

[21] Appl. No.: 948,060

[22] Filed: Oct. 2, 1978

[51] Int. Cl.[3] ..... B27F 7/17

[52] U.S. Cl. ..... 227/30; 227/153; 227/155

[58] Field of Search ..... 227/19, 155, 153, 30, 227/124

[56] References Cited

U.S. PATENT DOCUMENTS

| | | | |
|---|---|---|---|
| 855,244 | 5/1907 | Gros | 227/155 |
| 1,807,170 | 5/1931 | Peterson | 227/155 |
| 2,268,371 | 12/1941 | Bauwens | 227/155 |
| 2,899,679 | 8/1959 | Allen | 227/155 |
| 3,064,626 | 11/1962 | Kufel, Jr. | 121/11 |
| 3,474,947 | 10/1969 | Readyhough | 227/155 |
| 3,502,255 | 3/1970 | Hermann et al. | 227/3 |
| 3,625,408 | 12/1971 | Amakawa et al. | 227/131 |
| 4,032,228 | 6/1977 | Whited | 271/258 |
| 4,076,408 | 2/1978 | Reid et al. | 271/258 |

FOREIGN PATENT DOCUMENTS

| | | | |
|---|---|---|---|
| 167809 | 7/1959 | Sweden | 227/155 |

*Primary Examiner*—John McQuade
*Attorney, Agent, or Firm*—H. Fleischer

[57] ABSTRACT

An apparatus in which a plurality of articles are stapled to one another. The apparatus includes a commom member for actuating sequentially the stack clamper, staple driver and staple clincher.

5 Claims, 5 Drawing Figures

STAPLING APPARATUS

BACKGROUND OF THE INVENTION

This invention relates generally to an electrophotographic printing machine, and more particularly concerns an improved stapling apparatus therein.

In an electrophotographic printing machine, a photoconductive member is charged to a substantially uniform potential so as to sensitize the surface thereof. Thereafter, the charged portion of the photoconductive member is exposed to a light image of an original document being reproduced. Exposure of the charged photoconductive surface selectively discharges the charge thereon in the irradiated areas. This records an electrostatic latent image on the photoconductive surface corresponding to the informational areas contained within the original document being reproduced. After the electrostatic latent image is recorded on the photoconductive surface, the latent image is developed by bringing a developer mix into contact therewith. Generally, the developer mix comprises toner particles adhering triboelectrically to carrier granules. The toner particles are attracted from the carrier granules to the latent image in image configuration. Thereafter, the toner powder image is transferred to the copy sheet. Finally, the copy sheet is heated to permanently affix the toner particles thereto in image configuration. This general approach was originally disclosed by Carlson in U.S. Pat. No. 2,297,691 and has been further amplified and described in many related patents in the art.

Freqently, it is highly desirable to produce a plurality of sets of copies with each set of copies corresponding to a set of original documents. This is generally achieved by employing a recirculating document handling system in association with the electrophotographic printing machine. The recirculating document handling system is positioned on the platen of the printing machine and advances successive original documents onto the platen so that they may be exposed, and, subsequently reproduced. Each original document, after being exposed, is returned to the stack of original documents so that it may be re-imaged for the next successive copying cycle. In this manner, collated sets of copies are formed.

Often it is desirable to secure the copies of each set to one another forming a booklet thereof. This may be achieved by stapling the copies to each other. In high speed electrophotographic printing machines, it is highly desirable to actuate the stapling apparatus rapidly. Generally, this produces high forces and requires precise timing between successive operations. It is highly desirable to minimize the forces and distribute them so that the stapling apparatus does not produce excessive vibrations, and to minimize the length of timing between each operation, i.e. clamping the set of copy sheets, driving the staple through the set of copy sheets, and clinching the legs of the staple.

Accordingly, it is a primary object of the present invention to improve the stapling apparatus so as to minimize vibrations and optimize the operation cycle thereof.

PRIOR ART STATEMENT

Various types of devices which have hereinbefore been developed to improve stapling machines. The following prior art appears to be relevant:

Allen; U.S. Pat. No. 2,899,679; Aug. 18, 1959
Kufel, Jr.; U.S. Pat. No. 3,064,626; Nov. 20, 1962
Readyhough; U.S. Pat. No. 3,474,947; Oct. 28, 1969
Hermann et al.; U.S. Pat. No. 3,502,255; Mar. 24, 1970

The pertinent portions of the foregoing prior art may be briefly summarized as follows:

Allen, Kufel, Jr., and Readyhough all disclose pivotably mounted clinching fingers rotating in response to the driver driving the staple through the stack. The clinching fingers clinch the staple legs protruding through the stack.

Hermann et al. discloses a cam driven mechanism for advancing the driver which drives the staple through the stack of sheets.

It is believed that the scope of the present invention, as defined by the appended claims is patentably distinguishable over the foregoing prior art taken either singly or in combination with one another.

SUMMARY OF THE INVENTION

Briefly stated, and in accordance with the present invention, there is provided an apparatus for stapling a plurality of articles to one another.

Pursuant to the features of the invention, the apparatus includes means for clamping the articles together. Means are provided for driving a staple through the articles. Means clinch the portion of the staple legs protruding through the articles. A common member activates sequentially the clamping means, the driving means and the clinching means.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
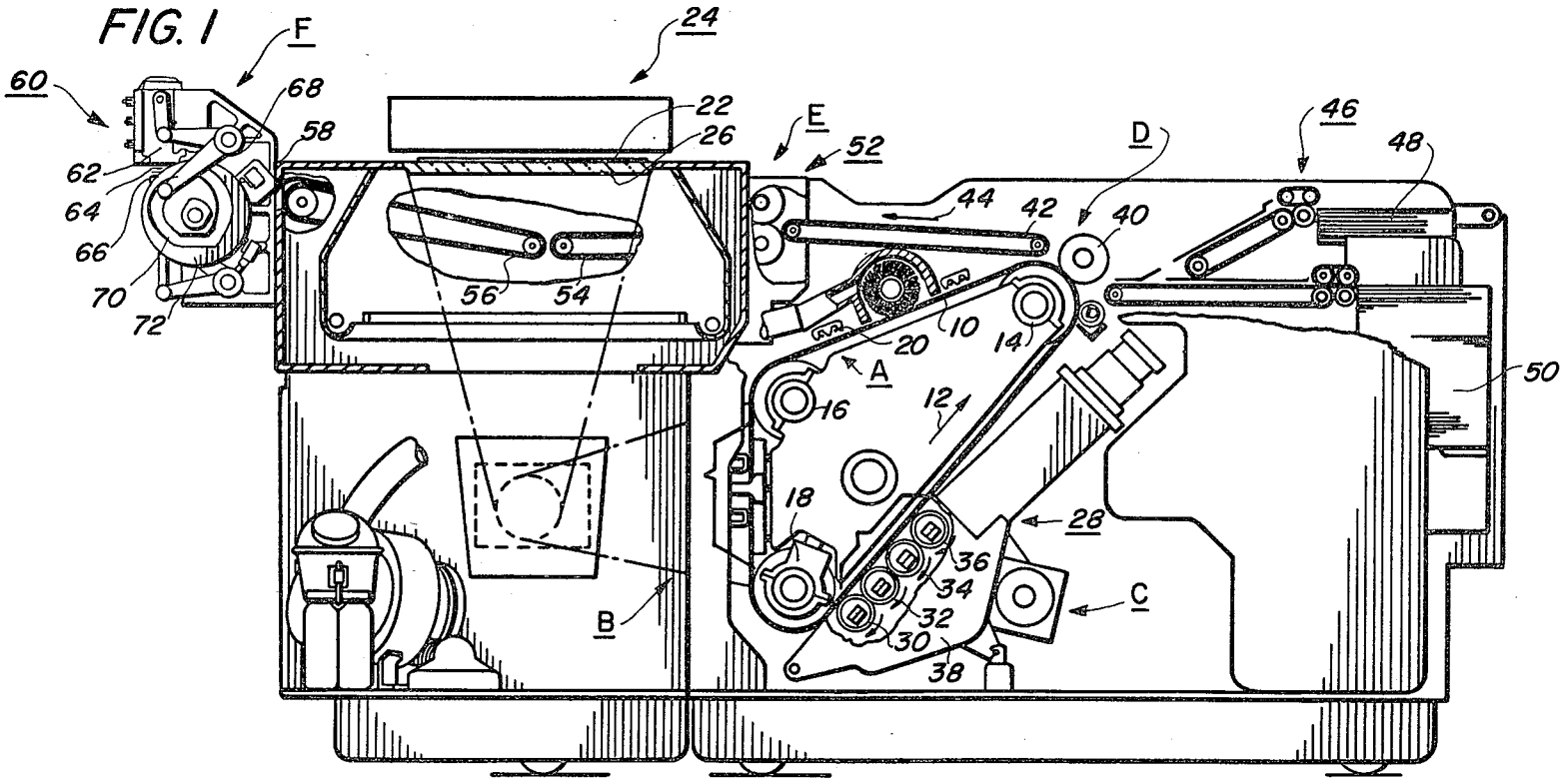
FIG. 1 is a schematic elevational view depicting an electrophotographic printing machine incorporating the features of the present invention therein.

For a general understanding of the illustrative electrophotographic printing machine incorporating the features of the present invention therein, reference is had to the drawings. In the drawings, like reference numerals have been used throughout to designate identical elements. FIG. 1 schematically depicts the various components of an electrophotographic printing machine having the stapling apparatus of the present invention therein. Although the stapling apparatus is particularly well adapted for use in an electrophotographic printing machine, it will become evident from the following discussion that it is equally well suited for use in a wide variety of machines and is not necessarily limited in its application to the particular embodiment shown herein.

Inasmuch as the art of electrophotographic printing is well known, the various processing stations employed in the FIG. 1 printing machine will be shown hereinafter schematically, and their operation described briefly with reference thereto.

As shown in FIG. 1, the electrophotographic printing machine employs a belt 10 having a photoconductive surface, e.g., a selenium alloy, deposited on a conductive substrate, e.g. aluminum. Belt 10 moves in the direction of arrow 12 to advance sequentially through the various processing stations disposed about the path of movement thereof. Rollers 14, 16, and 18, support belt 10 movably. A drive mechanism, i.e. a suitable motor (not shown), is coupled to roller 14 and advances belt 10 in the direction of arrow 12.

Initially, a portion of belt 10 passes through charging station A. At charging station A, a corona generating device, indicated generally by the reference numeral 20, charges the photoconductive surface of belt 10 to a relatively high, substantially uniform potential. A suitable corona generating device is described in U.S. Pat. No. 2,836,725, issued to Vyverberg in 1958.

Thereafter, the charged portion of photoconductive belt 10 is advanced through exposure station B. At exposure station B, an original document 22 is advanced by a recirculating document handling system, indicated generally by the reference numeral 24, onto a transparent platen 26. Recirculating document handling system 24 stores a set of original documents. Successive original documents are advanced from the positioned face down on the platen 26. After each original document is exposed, it is returned to the top of the set of original documents by the recirculating document handling system for subsequent re-imaging. Preferably, recirculating document handling system 24 is of the type described in U.K. Pat. No. 1,492,466, the relevant portions thereof being hereby incorporated into the present application. Each original document 22 positioned on platen 26 is exposed by a lamp which flashes light rays thereon. The light rays reflected from original document 22 pass through the optics of the exposure system forming a light image containing the informational areas of the original document therein. The optics, e.g. a suitable lens and mirrors, of the exposure system project the light image onto the charged portion of the photoconductive surface of belt 10. In this manner, the charged photoconductive surface of belt 10 is discharged selectively by the light image of the original document. This records an electrostatic latent image on the photoconductive surface of belt 10 which corresponds to the informational areas contained within original document 22.

Next, belt 10 advances the electrostatic latent image recorded on the photoconductive surface to development station C. At development station C, developer unit 28 comprises a plurality of magnetic brush developer rollers 30, 32, 34, and 36 disposed in housing 38. Each developer roller advances the developer mix into contact with the electrostatic latent image recorded on the photoconductive surface of belt 10. The developer mix comprises carrier granules having toner particles adhering triboelectrically thereto. This enables each magnetic brush developer roller to form a chain-like array of developer mix extending in an outwardly direction therefrom. The developer mix contacts the electrostatic latent image recorded on the photoconductive surface of belt 10. The latent image attracts the toner particles from the carrier granules forming a toner powder image on the photoconductive surface of belt 10.

The toner powder image recorded on the photoconductive surface of belt 10 is then transported to transfer station D. Transfer station D is located at a point of tangency on belt 10 as it moves around roller 14. A transfer roller 40 is located at transfer station D with the copy sheet being interposed between transfer roller 40 and belt 10. Transfer roller 40 is electrically biased to a suitable magnitude and polarity so as to attract the toner powder image from belt 10 to the surface of the copy sheet in contact therewith. After transferring the toner powder image to the copy sheet, conveyor 42 advances the copy sheet in the direction of arrow 44 to fixing station E.

Prior to proceeding with the description of fixing station E, sheet feeding apparatus 46 will be briefly described. Sheet feeding apparatus 46 includes a sheet transport which advances, in seriatim, successive copy sheets from stack 48 or, in lieu thereof, stack 50. The machine programming enables the operator to select the desired stack from which the copy sheets will be advanced. Thus, the selected copy sheet is advanced to transfer station D where the toner powder image adhering to the photoconductive surface of belt 10 is transferred thereto.

Fixing station E includes a fuser assembly, indicated generally by the reference numeral 52. Fuser assembly 52 comprises a heated fuser roll and a back-up roll. The copy sheet having the toner powder image thereon passes between the fuser roll and the back-up roll. The toner powder image on the copy sheet contacts the heated fuser roll. In this way, the toner powder image is permanently affixed to the copy sheet. After fusing, conveyors 54 and 56 advance the copy sheet to finishing station F.

Finishing station F includes a tray 58 for receiving, stacking, and jogging copy sheets into an ordered set. A stapling apparatus, indicated generally by the reference numeral 60 secures the set of copy sheets into a booklet. Stapling apparatus 60 comprises a head 62 which is moved into contact with the stack of sheets 64 on tray 58. In this manner, the stack 64 is clamped between head 62 and a clamping surface 66. Clamping surface 66 is stationary. Movement of head 62 is affected by movement of linkage 68 which has a cam follower riding in contoured surface 70 of cam 72. Similarly, a second contoured surface (not shown) on cam 72 has a cam follower of linkage 74 riding thereon. Linkage 74 actuates a stapler head to drive a staple through the stack of clamped copy sheets. As cam 72 continues to rotate, linkage 68 moves head 62 to actuate the clinching mechanism for bending the portion of the staple legs protruding through stack 64 into contact therewith. The detailed structure of stapling apparatus 60 will be described hereinafter with reference to FIGS. 2 through 5, inclusive.

Figure 2:
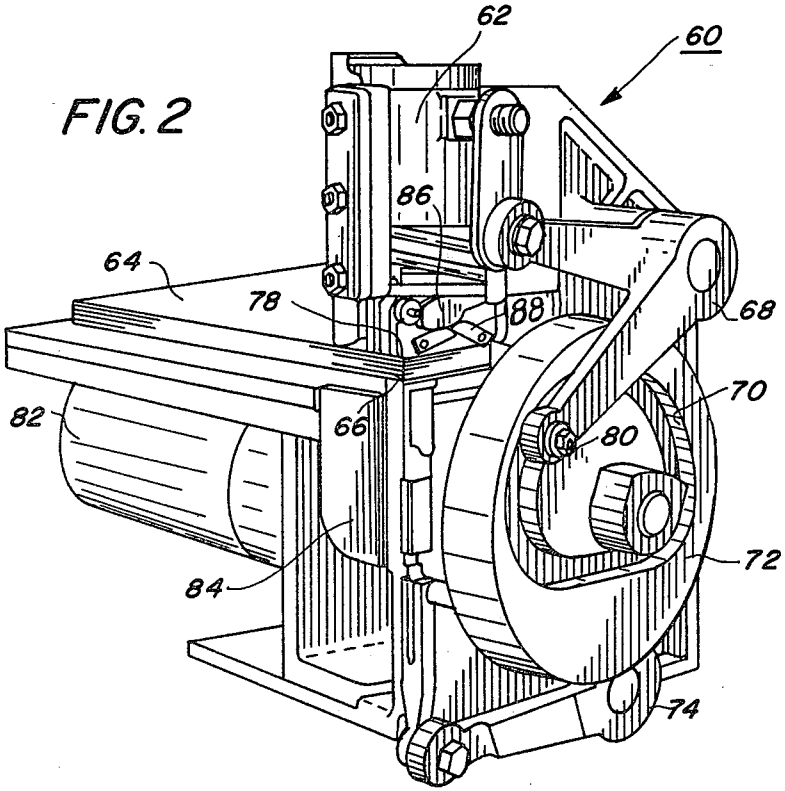
FIG. 2 is a schematic perspective view of a stapling apparatus employed in the FIG. 1 printing machine.

Referring now to FIG. 2, there is shown a perspective view of stapling apparatus 60. As depicted thereat stack 64 is disposed between head 62 and stationary clamping surface 66. As cam 72 rotates, linkage 68 moves head 62 compressing spring 76 so as to move clamping portion 78 of head 62 into engagement with stack 64. Linkage 68 is fixedly attached to head 62 at one end portion thereof with the other end portion thereof having a cam follower 80 disposed in contoured surface 70 of cam 72. Motor 82 rotates cam 72 at a constant angular velocity. As motor 82 rotates cam 72, linkage 74 having a cam follower 92 (FIG. 3) disposed in a contoured surface 94 (FIG. 3) on the other side of cam 72 actuates stapler head 84. Preferably, stapler head 84 is a model 62E stapler head manufactured by the Bostich Corporation. Actuation of staper head 84 causes a staple to be driven through stack 64. As cam 72 continues to rotate, linkage 68 continues to move head 62. This causes cam 86 to pivot into engagement with clinching ears 88. Clinching ears 88 pivot into contact with the portion of the staple legs protruding through stack 64 binding them into contact therewith. Preferably, clinching ears 88 form a by-pass clinch. By this it is meant that the staple legs may be adjacent and parallel to one another rather than abutting one another. To this end, clinching ears 88 are also partially adjacent and parallel to one another. The detailed structure of the clinching assembly will be described hereinafter with reference to FIG. 5. However, it should be noted that as linkage 68 continues to move head 62, spring 76 further compresses so that clamping surface 78 remains in contact with stack 64 during the clinching operation.

Figure 3:
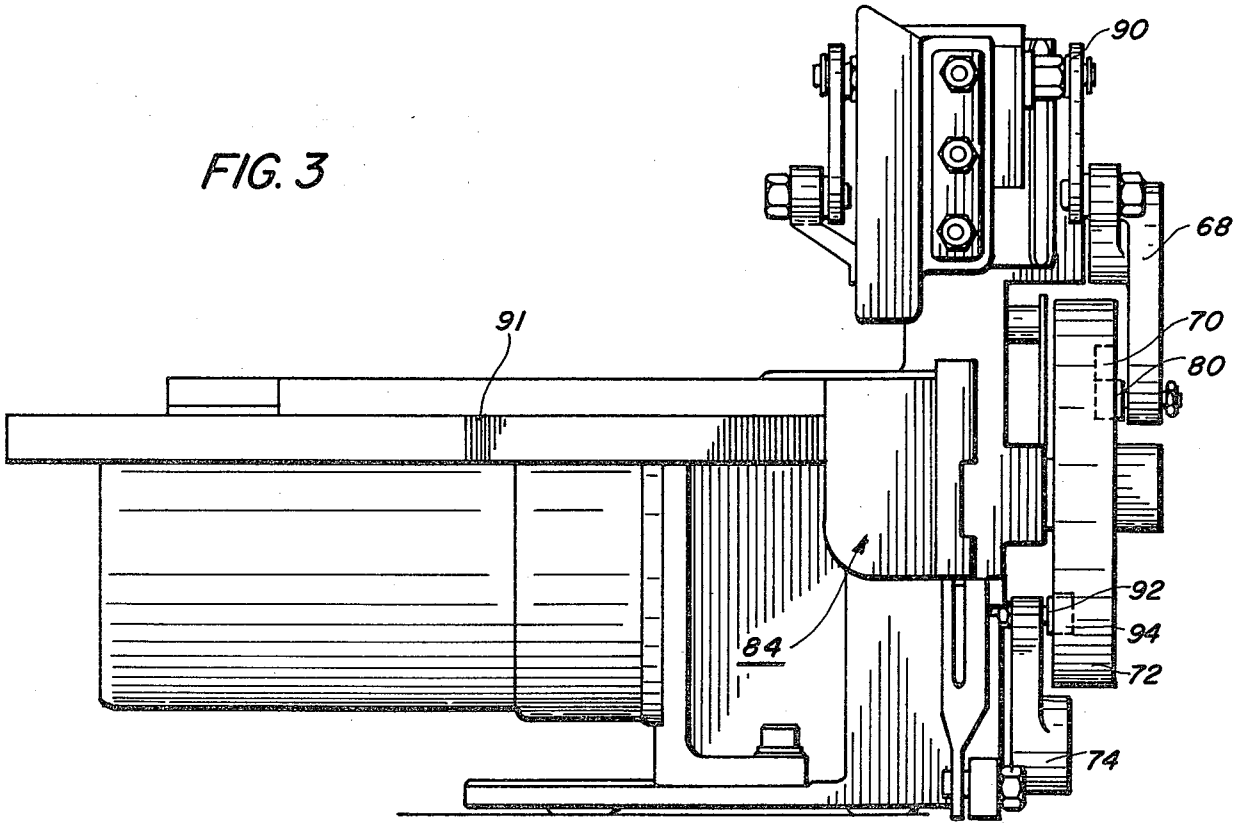
FIG. 3 is a side elevational view of the FIG. 2 stapling apparatus.

Turning now to FIG. 3, there is shown a portion of the stapling apparatus in greater detail. As depicted in FIG. 3, stapler head 84 comprises a staple magazine 91 for storing a supply of staples therein. The staples are automatically advanced from magazine 91 to stapler head 84 so that the driver of stapler head 84 may drive successive staples through each set of sheets clamped between clamping surface 78 and stationary clamping surface 66. As shown in FIG. 3, cam 72 includes a contoured surface 70 in which cam follower 80 of linkage 68 rides. The other end portion 90 of linkage 68 is secured to head 62. Cam follower 92 of linkage 74 rides in contoured surface 94 of cam 72. The other end portion 96 of linkage 74 actuates the driver of stapler head 84 which drives the staple through the stack of sheets.

Figure 4:
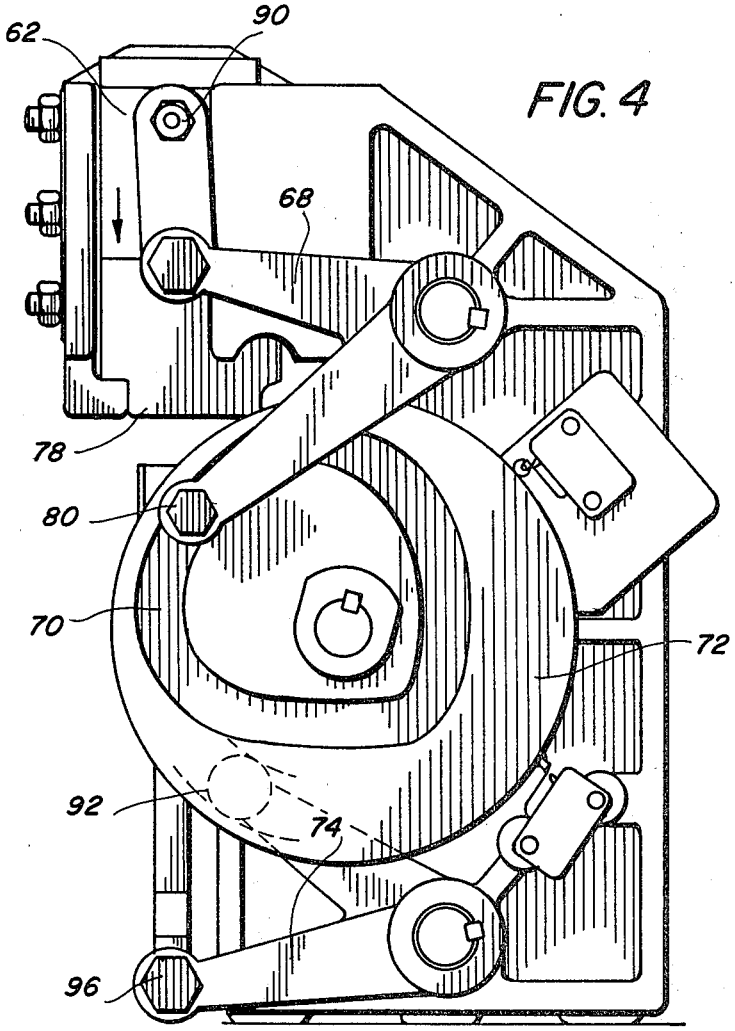
FIG. 4 is a front elevational view of the FIG. 2 stapling apparatus.

Referring now to FIG. 4, as cam 72 rotates, cam follower 80 follows the profile of contoured surface 70. In this way, linkage 68 moves head 62 so that clamping surface 78 engages the upper surface of stack 64. Similarly, cam follower 92 rides in contoured surface 94. In this way, linkage 74 moves so that the end portion 96 thereof coupled to the stapler head driver causes a staple to be driven through stack 64.

Figure 5:
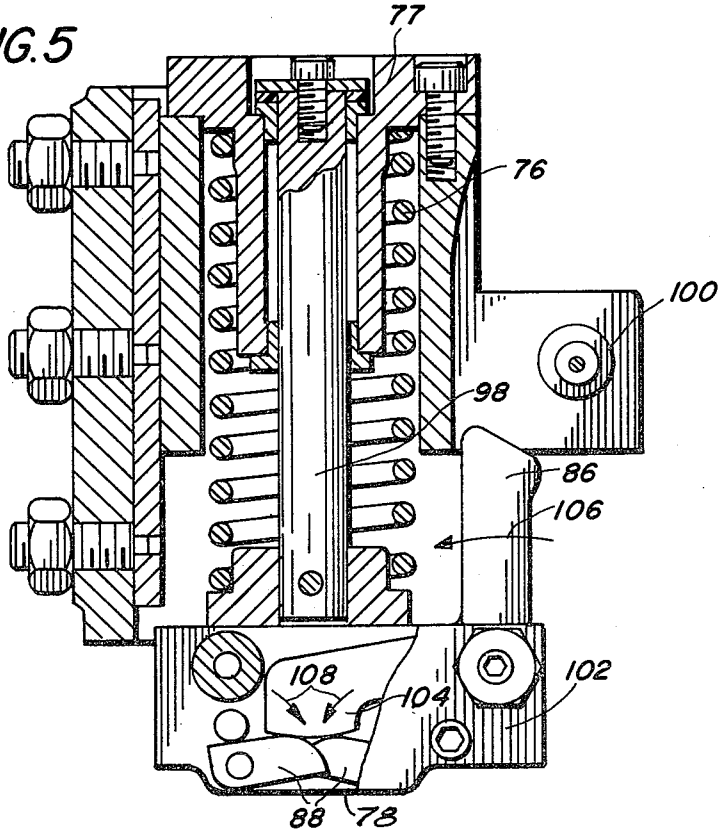
FIG. 5 is a fragmentary, enlarged sectional elevational view.

Turning now to FIG. 5, there is shown the detailed structure of head 62 and the clinching mechanism. Clamping surface 78 is secured to rod 98. Rod 98 passes through the center of coil spring 76 and is fastended to upper member 77 of head 62. One end portion of coil spring 76 engages member 77 while the other end portion thereof engages clamping surface 78. After the staple has been driven through the stack of sheets, head 62 is moved by linkage 68. As head 62 moves, collar 100 engages cam 86. Cam 86 is mounted pivotably on frame 102.

As collar 100 moves with head 62, it engages cam 86. Cam 86 pivots so that end portion 104 thereof engages clinching ears 88. Clinching ears 88 are mounted pivotably on frame 102. As cam 86 pivots in the direction of arrow 106 clinching ears 88 pivot in the direction of arrow 108. Clinching ears 88 engage the portion of the staple legs protruding through the stack of sheets and bend staple legs back into contact with the surface of the sheets.

In recapitulation, it is evident that the stapling apparatus of the present invention includes a cam which actuates a head for clamping a stack of sheets fixedly. Thereafter, the cam energizes a stapler head to drive a staple through the clamped stack of sheets. Next, the cam moves a pair of clinching ears into engagement with the portion of the staple leg protruding through the stack of sheets to fold the staple legs back into contact with the stack of sheets. Thus, a common cam is employed in the stapling apparatus for effecting clamping, stapling, and clinching. Inasmuch as the clamping operation and clinching operation is done on one side of the cam while the stapling operation is done on the other side of the cam and the cam, itself, in association with the linkages are rather massive, vibrations and forces are minimized. In addition, the contoured surfaces on either side of the cam are shaped so as to minimize and optimize the various motion parameters of the linkage, such as velocity, acceleration and jerk. Moreover, since a common cam is employed for all of the foregoing operations, it is readily easy to affect the proper timing of these operations with little or no error. This optimizes the timing cycle.

It is, therefore, evident that there has been provided in accordance with the present invention, a stapling apparatus that fully satisfies the objects, aims, and advantages hereinbefore set forth. Although this invention has been described in conjunction with a specific embodiment thereof, it is evident that many alternatives, modifications, and variations will be apparent to those skilled in the art. Accordingly, it is intended to embrace all such alternatives, modifications, and variations that fall within the spirit and broad scope of the appended claims.

What is claimed is:

1. An apparatus for stapling a plurality of articles to one another, including:

means for clamping the articles together;

means for driving a staple through the clamped articles;

means for clinching the portion of the staple legs protruding through the articles;

a common member; and means for coupling said common member to said clamping means, said driving means and said clinching means to enable said common member to activate sequentially said clamping means, said driving means, and said clinching means.

2. An apparatus as recited in claim 1, wherein said clamping means includes:

a stationary member for supporting the articles;

a movable clamping member;

a movable head connected to said coupling means with said common member being connected to said coupling means; and a spring interposed between said clamping member and said movable head, said common member driving said coupling means to move said movable head to a first position compressing said spring which moves said clamping member into engagement with the articles disposed on said stationary member to effect clamping thereof.

3. An apparatus as recited in claim 2, wherein said clinching means includes:

a pair of pivotably mounted clinching ears; and means for pivoting said clinching ears into engagement with the portion of the staple legs protruding through the articles to effect clinching thereof, said pivoting means being actuated in response to said common member driving said coupling means to move said movable head to a second position further compressing said spring.

4. An apparatus as recited in claim 3, wherein said driving means includes a stapler head, said common member driving said coupling means to energize said stapler head to drive a staple through the clamped articles.

5. An apparatus as recited in claim 4, wherein:

said common member includes a rotatably mounted member having a pair of contoured surfaces; and said coupling means includes a first linkage having one end portion thereof coupled to said movable head and the other end portion thereof having a cam follower riding on one of the contoured surfaces of said rotatably mounted member, and a second linkage having one end portion thereof coupled to said stapler head and the other end portion thereof having a cam follower riding on the other contoured surface of said rotatably mounted member.

* * * * *